US005639083A

United States Patent [19]

Doucet

[11] Patent Number: 5,639,083

[45] Date of Patent: Jun. 17, 1997

[54] DEVICE FOR THE DELIVERY OF FOLDED PRODUCTS

[75] Inventor: Louis John Doucet, Salem, N.H.

[73] Assignee: Heidelberger Druckmaschinen AG, Heidelberg, Germany

[21] Appl. No.: 275,690

[22] Filed: Jul. 14, 1994

[51] Int. Cl.[6] ..... B65H 29/20

[52] U.S. Cl. ..... 271/315; 270/60

[58] Field of Search ..... 271/187, 299, 271/302, 315; 270/47, 60

[56] References Cited

U.S. PATENT DOCUMENTS 5,029,842 7/1991 Belanger et al. .
5,064,180 11/1991 Wingate .
5,112,033 5/1992 Breton ..... 271/315

FOREIGN PATENT DOCUMENTS 0243458 9/1990 Japan ..... 271/315
2168686 6/1986 United Kingdom ..... 271/315

*Primary Examiner*—H. Grant Skaggs
*Attorney, Agent, or Firm*—Kenyon & Kenyon

[57] ABSTRACT

The invention relates to a device for the delivery of folded products with fan arrangements that are positioned opposite to one another. Multiple fans are disposed in spaced relation on a common axis of rotation. The circumferences of the fans overlap in the region of the fan blade ends. Furthermore, the fan blades include a mechanism for preventing the collision of fan blade tips situated opposite to one another. The fan blades also include an adjustable biasing mechanism for biasing the fan blade ends.

25 Claims, 3 Drawing Sheets

DEVICE FOR THE DELIVERY OF FOLDED PRODUCTS

BACKGROUND OF THE INVENTION

The invention relates to a device for the delivery of folded products with fan arrangements which are positioned opposite to one another.

With the processing of folded products very high demands are made on folding apparatuses which generally are arranged behind high-speed rotary printing presses. The continuous product stream being created has to be directed securely into receiving pockets of fan arrangements, in order to slow-down the folded products and to enable delivery thereof in a shingled stream on a transport tape.

From U.S. Pat. No. 5,112,033 a device is known, wherein the individual folded produces of a product stream are received by respective pockets of alternating fan wheels. For this purpose the circumferential circles defined by the fan blade tips of the fan arrangements situated opposite to one another overlap. In order to avoid collision of the fan blade tips with one another, the individual fan blades of each fan arrangement are provided with recesses, and the tip of the respective opposite fan blade can dip into a corresponding recess.

It has become apparent that centrifugal forces created by high rotary speeds and the dimensional tolerances allowed in the manufacture of large parts have a negative influence, which makes it difficult for the fan blade tips to keep their exact predetermined positions. The deviation of the fan blade tips in axial as well as in radial direction from their predetermined end position should, however, fall within a narrow tolerance range with respect to both sides of the predetermined end position, in order to ensure optimal running smoothness as well as absolute operating safety.

SUMMARY OF THE INVENTION

In view of the above-mentioned state of the art, it is the object of the present invention to ensure that fan blade tips maintain their predetermined position, particularly at high rotary speeds.

The solution according to the present invention, furthermore, serves the purpose of compensating for manufacturing tolerances, so that even those parts with a dimension at the tolerance limit still can be used.

It is an additional object of the invention to reinforce one fan wheel arrangement.

According to the invention, these objects can be achieved by way of a device for truing fan blades of an apparatus for receiving and delivering folded products. The fan blades each have a first side or face and a second side, as well as a tip. The fan blades moreover are organized in at least one fan arrangement that is disposed so as to rotate about an axis. The circumference of the fan arrangement overlaps with the circumference of another such fan arrangement which rotates about an axis that is parallel to the axis about which the first mentioned fan arrangement rotates. The device for truing fan blades includes a biasing member having a first end and a second end. The first end is coupled to the fan blade at a first position on the first face of the fan blade. A coupling is fixed or coupled to the first face of the fan blade at a second position. This coupling secures the second end of the biasing member. The device also includes an adjustment mechanism which is disposed adjacent to the coupling and which is coupled to the biasing member to permit modification of the tension of the biasing member. With this configuration, a change in the tension of the biasing member effects a change in the position of the tip of the corresponding blade.

The solution according to the present invention permits the fan arrangements situated opposite to one another to be biased in an advantageous way. The degree of bias can be selected through the biasing means such that the positions of the fan blade tips, when stationary or at operating speed, can be precisely controlled. The process for precisely positioning the fan blade tips can either be made dependent on the elasticity of the material of which the fans are made or on the operating speed of the fan arrangements, allowing for exact compensation of tolerances on each fan blade. According to an aspect of the present invention an axial movement of the fan blade ends parallel to the axis of rotation can be achieved by way of a loosening or tightening of the corresponding biasing means.

According to another aspect of the present invention means are provided for biasing the fan blade tips on both sides of fan blade segments. This allows for an axial adjustment of the fan blade ends from either side, using an embodiment of the invention as a tensioning device.

Also, the biasing means could be provided on one side of the fan blade segment. In this case a tensioning of the device will move the fan blade ends towards the side on which the device is installed. A loosening of the device will move the fan blade end away from the side on which the device is installed, due to the inherent tension of the fan blade material.

Furthermore, the biasing means can be spoke-shaped and be provided with adjustment means. The fan blades of each fan segment or fan can have multiple openings for receiving the spoke-shaped biasing means. This allows a wide-range variation in biasing characteristics of the individual fan blades.

The openings in the fan blades may serve to receive the angular ends of the biasing means. Moreover, bearing elements may be disposed in the openings in which the biasing means can be received. In order to simplify the biasing of the fan blades, the biasing means are received in abutments in the region of the adjustment means. On a fixture which may be provided with a slot-shaped alignment device, the individual fan blades and/or the blade tips thereof are aligned in the axial as well as in the circumferential direction through the loosening or tightening of the biasing means in such a manner that the distance between each blade tip and the edge of the alignment device is equal. Thus, the positions of the individual fan blade tips can be accurately adjusted, depending on the fan blade material, manufacturing tolerance and operating speed, so that great improvement in smooth and safe operation is achieved.

BRIEF DESCRIPTION OF THE DRAWINGS

Further characteristic features of the invention will be explained in the following description, which will be best understood when read in connection with the accompanying drawings, in which.

DETAILED DESCRIPTION

Figure 1:
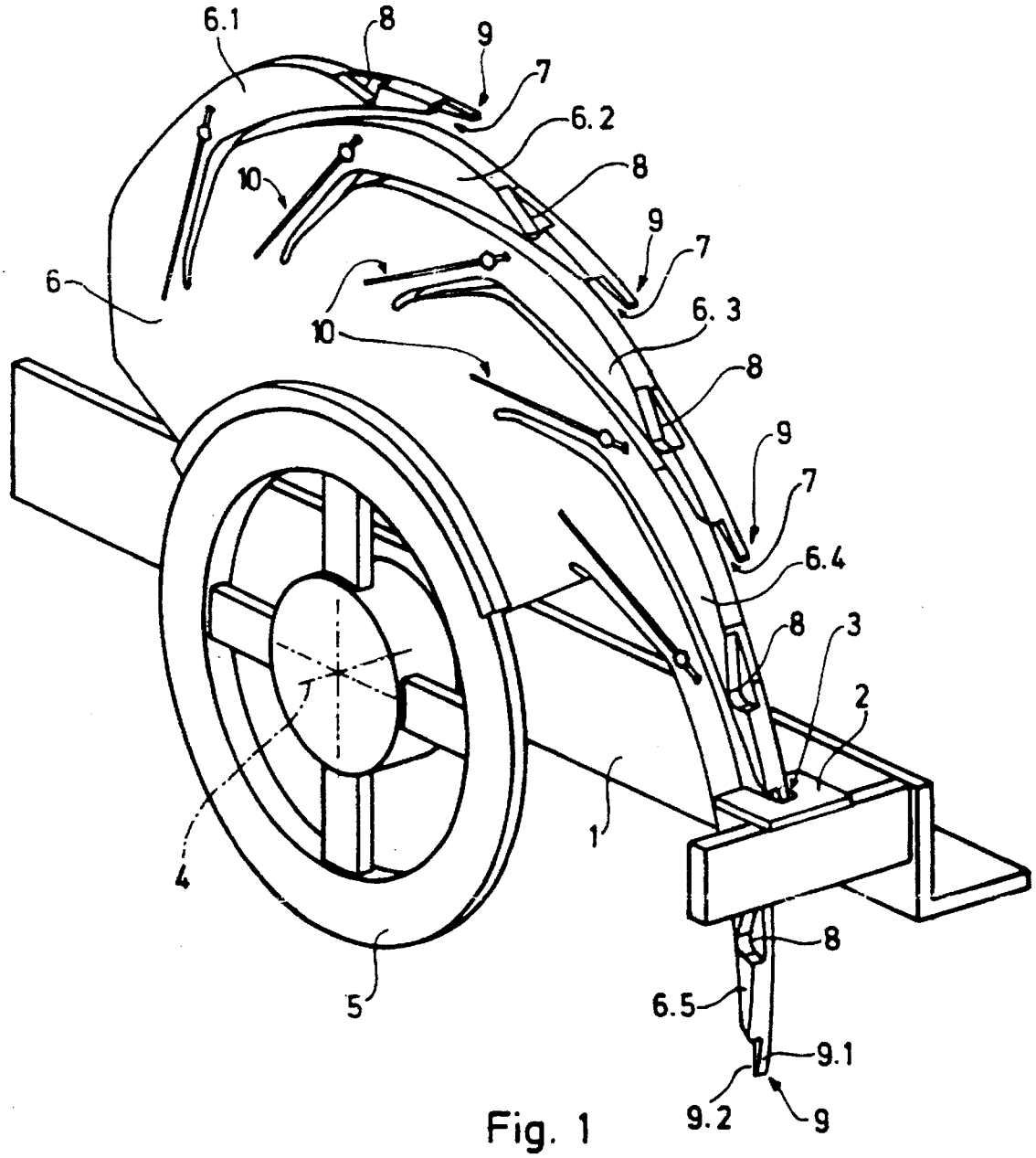
FIG. 1 is a perspective view of a fan segment.

FIG. 1 illustrates a perspective view of a fan segment 6 consisting of five fan blades 6.1, 6.2, 6.3, 6.4 and 6.5.

The fan segment 6 is rotatable around an axis of rotation 4 which is mounted in a frame part 1. On the frame part 1 there is provided an alignment device 2 having a slot-shaped opening 3 through which all fan blades 6.1, 6.2, 6.3, 6.4 and 6.5 can be rotated. In the embodiment illustrated herein the fan segment 6 is supported on a symmetrical carrier 5. A complete fan thus consists of three fan segments 6. This is easier to manufacture. However, it would also be feasible for a fan to consist of one part arranged on a carrier 5 so as to rotate around the axis of rotation 4.

Between the individual fan blades 6.1, 6.2, 6.3, 6.4 and 6.5 there are formed pockets 7 into which the folded products from the transport tapes enter. The respective pockets 7 have a curved contour and are defined by two adjacent fan blades 6.1, 6.2, 6.3, 6.4 and 6.5. Each of the individual fan blades 6.1–6.5 of the shown fan segment 6 has a recess 8. During the rotation of two fans that are situated opposite to one another, the fan blade tip of a respective opposite fan blade dips into the recess 8. In this manner, a collision of fans that are situated opposite to one another and having overlapping circumferences can be avoided. Each of the fan blades 6.1–6.5 has a fan blade end 9 (see lower part of FIG. 1), a blade tip 9.1 and an adjacent free space 9.2. It is the blade tip 9.1 which dips into the recesses 8 of the fan (not shown) that is situated opposite to the fan segment 6 shown in FIG. 1. Each one of the fan blades 6.1–6.5 has the same configuration of the blade ends 9, a blade tip 9.1 and an adjacent free space 9.2. Each of the shown fan blades 6.1–6.5 is provided with a spoke-shaped, slim tensionable biasing means 10. With these biasing means 10 a bias which exceeds the inherent tension of the material can be created between each of the fan blade ends 9 and the fan segment 6, and this bias can be maintained and adjusted, if required.

Figure 2:
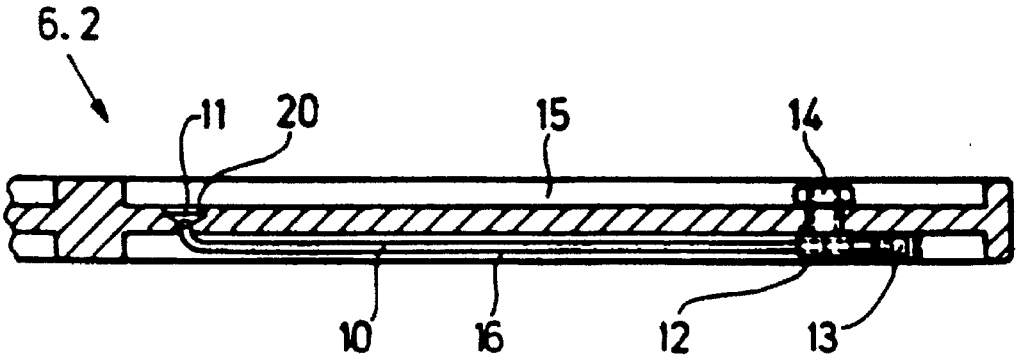
FIG. 2 is a cross-section of a biased fan blade with an angled tensioning biasing means.

FIG. 2 illustrates a cross-section of a biased fan blade 6.2 with the angled biasing means. This fan blade 6.2 is provided with recesses 15 and 16 for receiving the biasing means 10, which may comprise a spoke-shaped biasing or tension member. In this exemplary embodiment only one biasing means 10 is shown. The angled, broad end of the biasing means 10, serving as its base, is disposed in an opening 20 in the body of the fan blade 6.2. The other end of the spoke-shaped biasing means 10 is held in an abutment 12 secured to the fan blade 6.2 by means of a nut 14. Adjacent to the abutment 12 there is shown an adjustment means 13, which may for example be a nipple, by means of which the tension of the spoke-shaped biasing means 10 can be changed. In this embodiment an adjustment means 13 is installed only on one side of the fan segment 6. A tightening of the adjustment means 13, causes movement of the fan blade end 9 parallel to the axis of rotation and towards the blade side to which the biasing means 10 is mounted. A loosening of the adjustment means 13 causes movement away from the blade side to which the biasing means 10 is mounted by utilizing the inherent tension of the fan blade material. By way of such loosening or tightening, the tip of each fan blade may be trued with precision to its appropriate position.

In coordination with the alignment device on frame 1, as shown in FIG. 1, the distance of each fan blade end 9 from the opening 3 of the alignment device can be set accurately by means of the respective biasing means 10. This does not only apply to radial adjustment of the fan blade ends 9. If, for example, biasing means 10 are provided on both sides of the fan blade 6.2, even possible manufacture-related imbalances in the parts can be compensated. The lateral distance of the fan blade end 9 of each fan blade 6.1–6.5 with respect to the slot-shaped opening 3 can be set accurately through the spoke-shaped biasing means 10, so that overlapping fan blades being situated opposite to one another cannot collide during operation. The tension to be applied to the material can be rated such that centrifugal forces occurring during operation of the fan blades at machine speed are already taken into account. The fan blade ends 9 are held in a position corresponding to the predetermined position, so that an exact dipping-in of the blade tips 9.1 into the respective recesses 8 of the opposite fan is ensured.

If complete fans or, as illustrated herein, individual fan segments with inherent manufacturing tolerances are used, these tolerances can be compensated by biasing the fan blade ends 9 to effect a positional adaptation of the blade tips 9.1.

FIG. 2 shows an exemplary opening 20 in the fan blade 6.2. Actually, there may be provided several openings 20 in each of the individual fan blades 6.1–6.5, into which the angled ends of the spoke-shaped biasing means 10 can be hooked. This would enable the biasing characteristics to be adapted when biasing means 10 of different lengths are used.

Figure 3:
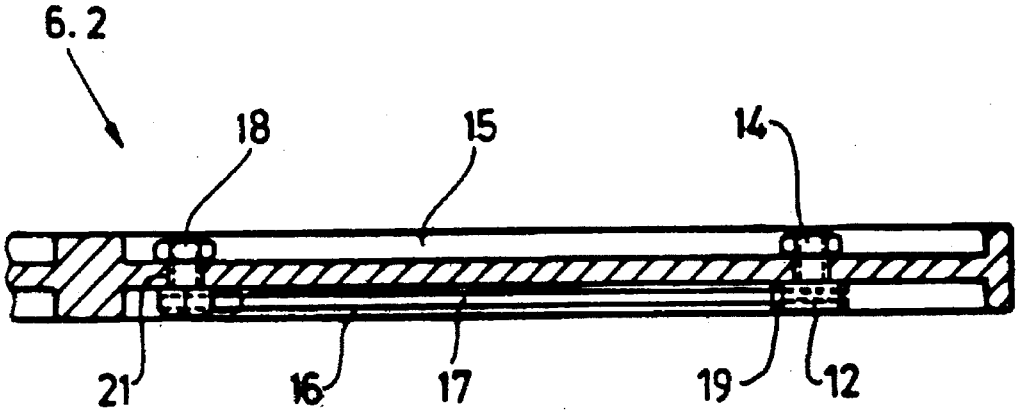
FIG. 3 is a cross-section of a biased fan blade with bi-directional biasing means supported in support pieces.

FIG. 3 shows a cross-section of a biased fan blade with adjustable biasing means supported in bearing elements. In this alternative embodiment a slim, adjustable biasing means 17 with a slotted head on one end and threaded on the other end is screwed into a bearing part 18. The biasing means 17 has a groove to receive a snap ring 19. The abutment 12 is captured between the snap ring 19 and the head of the biasing means 17. The bearing part 18 receiving the one end of the biasing means 17 as well as the abutment 12 receiving the opposite end of the biasing means 17 are secured to the fan blade 6.2 by means of nuts 14. In this configuration the biasing means 17 is required on only one side of the fan blade 6.2. When tightened, the head of the biasing means 17 is forced against the abutment 12 to create tension in the biasing means 17. The tension causes the fan end 9 to move laterally towards the blade side on which the biasing means 17 is installed. When the biasing means 17 is loosened, the snap ring 19 is forced against the abutment 12. A jacking force is created which causes the fan blade end 9 to move laterally away from the blade side on which the biasing means 17 is installed. The fan blade 6.2 also is provided with several openings 21, in order to effect a change in the biasing characteristics according to different lengths and elasticity of the biasing means 17.

It is understood that any possible readjustment of the bias, which may become necessary after long operation, can be carried out with ease and in short time.

Figure 4:
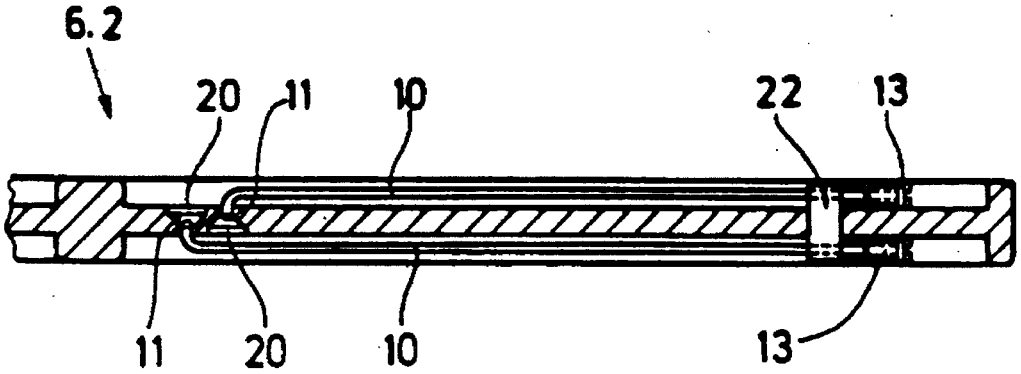
FIG. 4 is a cross-section of a biased fan blade with adjustment means on both sides of a fan segment.

FIG. 4 shows an embodiment of the present invention comprising spoke-shaped biasing means 10 in recesses 15, 16 provided on both sides of the fan blade 6.2. The openings 20 are arranged so as to be offset from one another. Using such a configuration the fan blade end 9 can be positioned in an axial direction to the axis of rotation, allowing an adjustment to either side of the fan blade. Furthermore, an alternate positioning of the fan blade ends 9 according to FIG. 6 can easily be accomplished. Using two biasing means to on both sides of the respective fan blade 6.1–6.5 allows the force acting upon one biasing means to be cut in half. An adjustment of fan blade ends 9 in radial direction can easily be achieved using biasing means 10 on both sides of the fan segment 6.

Figure 5:
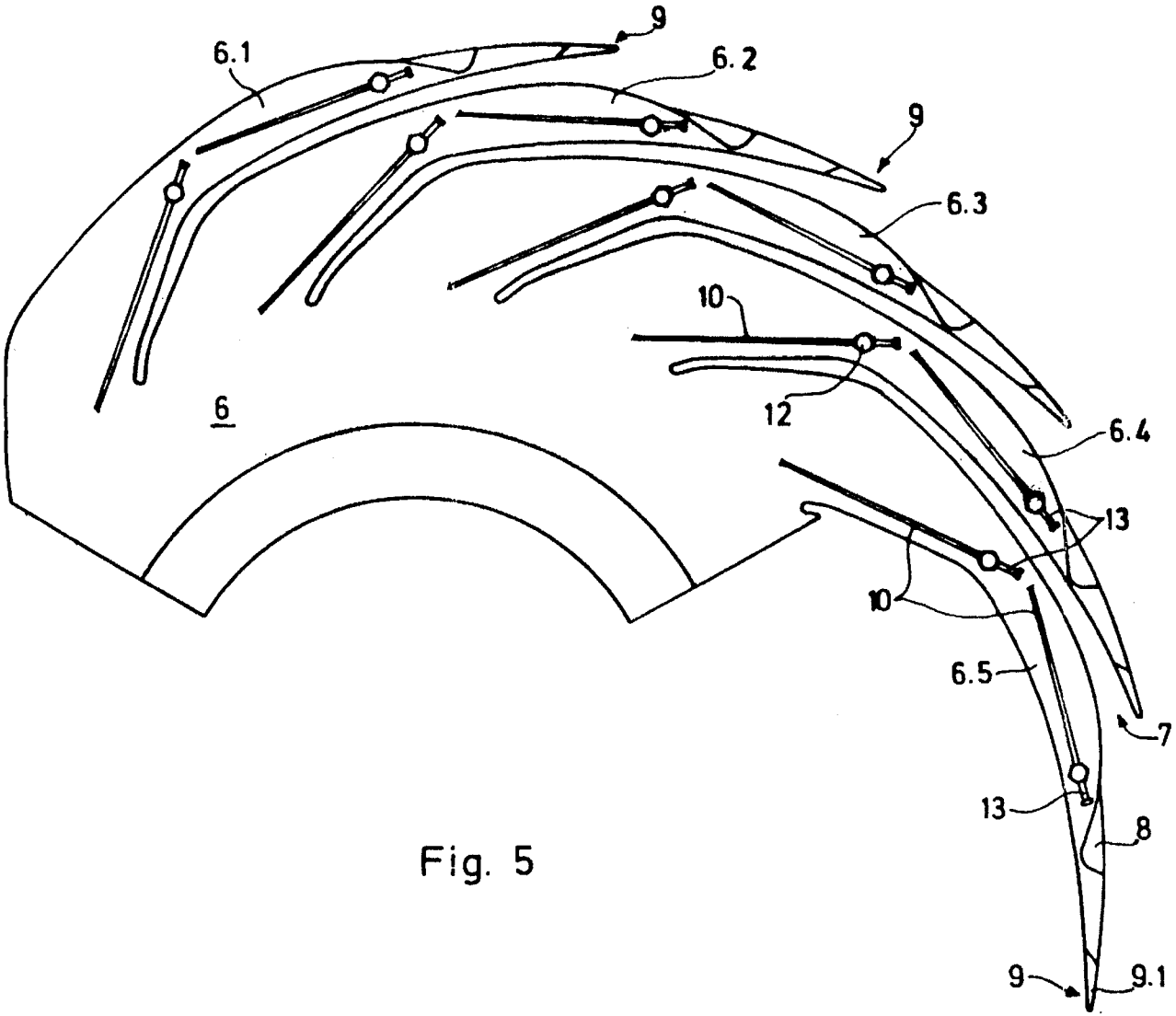

FIG. 5 shows a fan segment 6 with multiple biasing means 10 arranged in a series. The use of multiple biasing means 10 would provide for a greater degree of fan blade ends 9 repositioning. This applies for axial as well as for radial adjustments.

Figure 6:
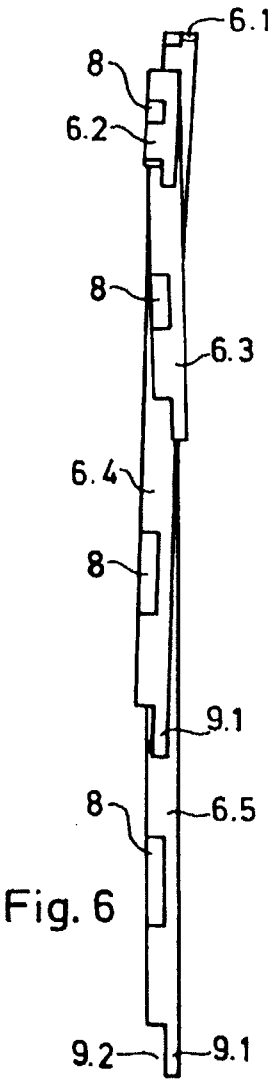
FIG. 5 is a side view of a fan segment having adjustment means arranged in a series and FIG. 6 shows a configuration of fan blade ends being alternately positioned on opposite sides of the fan segment.

Finally, FIG. 6 shows a fan segment 6 having the fan blades 6.1–6.5 intentionally distorted into alternately arranged positions.

What is claimed is:

1. A device for truing fan blades of an apparatus for receiving and delivering folded products, the fan blades each having a first face, a second face, a tip, and being organized in at least one fan arrangement disposed to rotate about an axis so that the circumference of the fan arrangement overlaps with the circumference of another such fan arrangement that rotates about a parallel axis, the device comprising:

a biasing member having a first portion and a second portion, the first portion coupled to the fan blade at a first position and the second portion coupled to the fan blade at a second position; and an adjustment mechanism coupled to the biasing member for modifying the tension of the biasing member;

whereby a change in the tension of the biasing member effects a change in the position of the tip of the corresponding fan blade.

2. A device for truing fan blades of an apparatus for receiving and delivering folded products, the fan blades each having a first face, a second face, a tip, and being organized in at least one fan arrangement disposed to rotate about an axis so that the circumference of the fan arrangement overlaps with the circumference of another such fan arrangement that rotates about a parallel axis, the device comprising:

a biasing member having a first end and a second end, the first end coupled to the fan blade at a first position located on the first face of the fan blade;

a coupling coupled to the first face of the fan blade at a second position and securing the second end of the biasing member; and an adjustment mechanism disposed adjacent to the coupling and coupled to the biasing member for modifying the tension of the biasing member;

whereby a change in the tension of the biasing member effects a change in the position of the tip of the corresponding fan blade.

3. The device as recited in claim 2, further comprising a second biasing member having a first end and a second end, the first end coupled to the fan blade at a third position located on the second face of the fan blade, and a second coupling disposed in a fourth position on the second face of the fan blade for securing the second end of the second biasing member, and a second adjustment means adjacent to the second coupling and coupled to the second biasing member for modifying the tension of the second biasing member, wherein a change in the tension of each biasing member effects a change in the radial and axial positions of the tip of the corresponding fan blade.

4. The device as recited in claim 2, wherein the fan blade at the first position has an opening for receiving the first end of the biasing member and at the second position has an opening for receiving the coupling.

5. The device as recited in claim 4, further comprising a first bearing element disposed in the opening at the first position for receiving the first end of the biasing member and a second bearing element disposed in the opening at the second position for receiving the coupling.

6. The device as recited in claim 2, wherein the biasing member is spoke-shaped.

7. A device for truing fans blades of an apparatus for receiving and delivering folded products, the fan blades each having a first face, a second face, a tip, and a plurality of openings and being organized in at least one fan arrangement disposed to rotate about an axis so that the circumference of the fan arrangement overlaps with the circumference of another such fan arrangement that rotates about a parallel axis, the device comprising:

a plurality of biasing members each having a first end and a second end, each first end disposed in a respective first fan blade opening so that each biasing member is located on the first face of the fan blade;

a plurality of couplings corresponding to the biasing members and disposed in a respective second fan blade opening for securing the second end of each biasing member; and a plurality of adjustment mechanisms corresponding to the biasing members, each disposed adjacent to a corresponding couplings and coupled to a corresponding biasing member, for modifying the tension of the biasing member;

whereby a change in the tension of each biasing member effects a change in the position of the tip of the corresponding fan blade.

8. The device as recited in claim 7, wherein the plurality of biasing members are disposed in series.

9. The device as recited in claim 7, wherein the openings in the fan blade open out to the first and second sides of the fan blade, further comprising a second plurality of biasing members each having a first end and a second end, the first end disposed in a respective third opening so that each of the second plurality of biasing members is located on the second face of the fan blade; a second coupling disposed in a respective fourth fan blade opening for securing the second end of each of the second plurality of biasing members; and a second plurality of adjustment means each adjacent to a corresponding second coupling and coupled to a corresponding one of the second plurality of biasing members for modifying the tension of the second biasing member; wherein changes in the tension of the two pluralities of biasing members may effect a change in the radial and axial positions of the tip of the corresponding fan blade.

10. A device for truing fans blades of an apparatus for receiving and delivering folded products, the fan blades each having a first face, a second face, a tip, and being organized in at least one fan arrangement rotatably coupled to a frame for rotation about an axis such that the circumference of the fan arrangement overlaps with the circumference of another such fan arrangement that rotates about a parallel axis, the device comprising:

a biasing member having a first end and a second end, the first end coupled to the fan blade at a first position located on the first face of the fan blade;

a coupling coupled to the first face of the fan blade at a second position and securing the second end of the biasing member;

an adjustment mechanism adjacent to the coupling and coupled to the biasing member for modifying the tension of the biasing member so that a change in the tension of the biasing member effects a change in the position of the tip of the corresponding fan blade; and an alignment mechanism coupled to the frame and having a slot, the alignment mechanism positioned such that when the fan arrangement rotates the tips of the fan blades pass through the slot, whereby the alignment mechanism provides a reference for positioning the tip of the fan blade using the adjustment mechanism.

11. A device for receiving and delivering folded products, comprising:

a frame;

a plurality of fan arrangements rotatably coupled to the frame and positioned such that the circumferences of the fan arrangements partially overlap;

a plurality of fan blades corresponding to each fan arrangement, each fan blade having a first face, a second face, a tip, and a plurality of openings and being organized in at least one fan arrangement disposed to rotate about an axis so that the circumference of the fan arrangement overlaps with the circumference of another such fan arrangement that rotates about a parallel axis;

a plurality of biasing members corresponding to each fan blade, each biasing member having a first end and a second end, each first end disposed in a respective first fan blade opening so that each biasing member is located on the first face of the fan blade;

a plurality of couplings each corresponding to a biasing member and disposed in a respective second fan blade opening and securing the second end of each biasing member; and a plurality of adjustment mechanisms each corresponding to a biasing member, each adjustment mechanism disposed adjacent to a corresponding coupling and coupled to the corresponding biasing member for modifying the tension of the biasing member so that a change in the tension of each biasing member effects a change in the position of the tip of the corresponding fan blade; and a plurality of alignment mechanisms coupled to the frame, each alignment mechanism corresponding to a fan arrangement, each alignment mechanism further having a slot and being positioned such that when the corresponding fan arrangement rotates, the tips of the fan blades pass through the slot, each alignment mechanism thus providing a reference for the positioning of the tips of the fan blades of the corresponding fan arrangement using the adjustment mechanism.

12. A device for the delivery of folded products with fan arrangements having a plurality of blades and being positioned opposite one another, comprising:

multiple fans disposed in spaced relation on parallel rotational axis such that the circumferences of the fans overlap;

a plurality of fan blades coupled to each fan and including devices for the prevention of a collision of fan blade ends situated opposite to one another; and adjustable biasing means coupled to each fan blade for biasing the fan blade ends.

13. The device according to claim 12, wherein the biasing means are provided on a single side of the fan blades.

14. The device according to claim 12, wherein the biasing means are spoke-shaped.

15. The device according to claim 12, wherein multiple biasing means are assigned to a respective fan blade.

16. The device according to claim 15, wherein the biasing means are arranged in a series.

17. A device for the delivery of folded products with fan arrangements having a plurality of blades and being positioned opposite one another, comprising:

multiple fans disposed in spaced relation on parallel rotational axes such that the circumferences of the fans overlap;

a plurality of fan blades coupled to each fan and including devices for the prevention of a collision of fan blade ends situated opposite to one another; and adjustable biasing means coupled to each fan blade for biasing the fan blade ends the biasing means provided on both lateral sides of each fan blade.

18. The device according to claim 17, wherein the fan blades have several openings for receiving bearing parts.

19. The device according to claim 18, wherein bearing parts for fixedly mounting biasing means are disposed in the openings.

20. The device according to claim 17, wherein the fan blades have openings for receiving angled ends of the biasing means.

21. The device according to claim 17, wherein the biasing means are disposed in recesses of the fan blades.

22. A device for the delivery of folded products with fan arrangements having a plurality of blades and being positioned opposite one another, comprising:

multiple fans disposed in spaced relation on parallel rotational axes such that the circumferences of the fans overlap;

a plurality of fan blades coupled to each fan and including devices for the prevention of a collision of fan blade ends situated opposite to one another; and adjustable biasing means coupled to each fan blade for biasing the fan blade ends, the biasing means having adjustment means.

23. The device according to claim 22, wherein the biasing means in the region of the adjustment means are held in abutments.

24. A device for the delivery of folded products with fan arrangements having a plurality of blades and being positioned opposite one another, comprising:

multiple fans disposed in spaced relation on parallel rotational axes such that the circumferences of the fans overlap;

a plurality of fan blades coupled to each fan and including devices for the prevention of a collision of fan blade ends situated opposite to one another; and adjustable biasing means coupled to each fan blade for biasing the fan blade ends the fan blade ends being adjustable in circumferential direction by adjusting the adjustable biasing means relative to an alignment device coupled to a frame.

25. The device according to claim 24, wherein the fan blade ends are adjustable in parallel with the axis of rotation by adjusting the adjustable biasing means relative to the alignment device.

* * * * *